US007901200B2

(12) United States Patent
Satoh et al.

(10) Patent No.: US 7,901,200 B2
(45) Date of Patent: Mar. 8, 2011

(54) MOLDING APPARATUS

(75) Inventors: Takashi Satoh, Tokyo (JP); Sadaki Satoh, Tokyo (JP); Ken Kikuchi, Tokyo (JP); Masashi Gotoh, Tokyo (JP); Takeshi Itoh, Tokyo (JP); Takuo Kataho, Tokyo (JP)

(73) Assignee: TDK Corporation, Tokyo (JP)

( * ) Notice: Subject to any disclaimer, the term of this patent is extended or adjusted under 35 U.S.C. 154(b) by 816 days.

(21) Appl. No.: 11/655,080

(22) Filed: Jan. 19, 2007

(65) Prior Publication Data

US 2007/0231420 A1 Oct. 4, 2007

(30) Foreign Application Priority Data

Mar. 31, 2006 (JP) ..... 2006-098298
Aug. 10, 2006 (JP) ..... 2006-218806

(51) Int. Cl.
*B29C 43/04* (2006.01)

(52) U.S. Cl. ..... 425/344; 425/78; 425/345; 425/353; 425/411; 425/415; 264/113; 264/241; 264/260

(58) Field of Classification Search ..... 425/78, 425/344, 345, 346, 347, 348 R, 352, 353, 425/355, 356, 406, 411, 412, 415, 423, 349; 264/112, 113, 241, 259, 260
See application file for complete search history.

(56) References Cited

U.S. PATENT DOCUMENTS 2,946,298 A * 7/1960 Doepel et al. ..... 264/275
3,677,673 A * 7/1972 Shapiro ..... 425/78
3,773,446 A * 11/1973 Borrini ..... 425/78
4,008,021 A * 2/1977 Fedrigo et al. ..... 425/3
4,443,171 A * 4/1984 Dixon ..... 425/78
5,158,728 A * 10/1992 Sanderson et al. ..... 264/113

(Continued)

FOREIGN PATENT DOCUMENTS

JP A-60-162597 8/1985

(Continued)

OTHER PUBLICATIONS

English Translation of Office Action issued in a counterpart foreign application, Dec. 15, 2009.

(Continued)

*Primary Examiner* — Joseph S Del Sole
*Assistant Examiner* — Seyed Masoud Malekzadeh
(74) *Attorney, Agent, or Firm* — Oliff & Berridge, PLC

(57) ABSTRACT

A lower punch is arranged to be inserted into a cavity of a die from a lower side of the die. A upper punch is arranged to be inserted into the cavity from an upper side of the die to compact the powder filled in the cavity, in cooperation with the lower punch. A feeder supplies the powder into the cavity. A first cam driving system has a first cam for vertically moving the die relative to the lower punch. A second cam driving system has a second cam for vertically moving the upper punch. A third cam driving system has a third cam for moving the feeder forward or backward relative to the cavity. A contact member is connected to the first cam driving system. A stopper is located above or below the contact member and regulates relative vertical movement of the die with respect to the lower punch, in cooperation with the contact member. A fourth cam driving system has a fourth cam for vertically moving the stopper. The first cam, the second cam, the third cam, and the fourth cam are rotated in synchronism.

9 Claims, 17 Drawing Sheets

U.S. PATENT DOCUMENTS

| | | | | |
|---|---|---|---|---|
| 5,460,827 | A * | 10/1995 | Sanderson et al. | 424/472 |
| 5,554,327 | A * | 9/1996 | Ingram et al. | 264/40.5 |
| 5,670,100 | A * | 9/1997 | Ingram | 264/40.5 |
| 5,686,118 | A * | 11/1997 | Kurata | 425/122 |
| 5,762,978 | A * | 6/1998 | Trebbi | 425/345 |
| 5,866,177 | A * | 2/1999 | Ingram | 425/297 |
| 5,932,155 | A * | 8/1999 | Ingram | 264/40.5 |
| 6,123,880 | A * | 9/2000 | Ingram | 264/39 |
| 6,165,400 | A * | 12/2000 | Hinzmann | 264/120 |
| 6,361,305 | B1 * | 3/2002 | Hinzpeter et al. | 425/193 |
| 6,531,090 | B2 | 3/2003 | Ogawa | |
| 6,585,508 | B1 * | 7/2003 | Zuffa | 425/350 |
| 6,890,168 | B2 * | 5/2005 | Kim | 425/78 |
| 7,018,194 | B2 * | 3/2006 | Kitamura et al. | 425/193 |
| 7,025,582 | B2 * | 4/2006 | Battilani | 425/186 |
| 7,361,006 | B2 * | 4/2008 | Sowden et al. | 425/215 |
| 7,517,204 | B2 * | 4/2009 | Mercado | 425/78 |
| 2002/0090412 | A1 * | 7/2002 | Kitamura et al. | 425/259 |
| 2003/0072799 | A1 * | 4/2003 | Sowden et al. | 424/464 |
| 2004/0056375 | A1 * | 3/2004 | Bubb | 264/40.5 |
| 2004/0067275 | A1 * | 4/2004 | Trebbi et al. | 425/352 |
| 2004/0113319 | A1 * | 6/2004 | Kondo et al. | 264/319 |
| 2004/0191349 | A1 * | 9/2004 | Shimada | 425/345 |

FOREIGN PATENT DOCUMENTS

| | | |
|---|---|---|
| JP | A-03-090502 | 4/1991 |
| JP | A-06-065607 | 3/1994 |
| JP | 08-225804 A | 9/1996 |
| JP | A-2001-300790 | 10/2001 |
| JP | A-2002-210597 | 7/2002 |
| JP | 2003-290994 A | 10/2003 |
| JP | A-2005-205420 | 8/2005 |

OTHER PUBLICATIONS

English Language version of Jan. 5, 2010 Office Action issued in a counterpart Foreign Application.

Oct. 6, 2009 Office Action issued in Japanese Patent Application No. 2006-218797.

* cited by examiner

MOLDING APPARATUS

BACKGROUND OF THE INVENTION

1. Field of the Invention

The present invention relates to a molding apparatus for compacting powder into a predetermined shape.

2. Related Background Art

A known molding apparatus for compacting powder is a servo press machine, for example, as described in Japanese Patent Application Laid-Open No. 8-225804. This servo press machine has a die movable between a molding position and a molding removal position, a lower punch fixed at a predetermined position, and an upper punch vertically movable, and is arranged to fill a raw powder into a molding cavity constructed of the die and the lower punch and thereafter lower the upper punch to compact the raw powder by the upper punch and the lower punch, thereby obtaining a molded article.

SUMMARY OF THE INVENTION

However, the above-described conventional technology has the following problem. For continuously carrying out an overfill operation and an underfill operation, it is necessary to continuously move the die upward and downward. For this reason, if the die is attempted to move at high speed, the die will overshoot by virtue of inertia of the die and it will be hard to move the die as intended. Therefore, it was infeasible to perform the continuous overfill and underfill operations at high speed.

An object of the present invention is to provide a molding apparatus capable of performing the continuous overfill and underfill operations at high speed.

The present invention provides a molding apparatus for compacting a powder into a predetermined shape, comprising: a die having a cavity into which the powder is filled; a lower punch arranged to be inserted into the cavity from a lower side of the die; an upper punch arranged to be inserted into the cavity from an upper side of the die to compact the powder filled in the cavity, in cooperation with the lower punch; a feeder for feeding the powder into the cavity; a first cam driving system having a first cam for vertically moving the die relative to the lower punch; a second cam driving system having a second cam for vertically moving the upper punch; a third cam driving system having a third cam for moving the feeder forward or backward relative to the cavity; a contact member connected to the first cam driving system; a stopper located above or below the contact member and arranged to regulate relative vertical movement of the die with respect to the lower punch, in cooperation with the contact member; a fourth cam driving system having a fourth cam for vertically moving the stopper; and drive synchronizing means for rotating the first cam, the second cam, the third cam, and the fourth cam in synchronism.

As molding is performed by means of the molding apparatus as described above, a molded article is fabricated as follows during a rotation of the first cam, the second cam, the third cam, and the fourth cam in synchronism. Namely, the powder is first filled from the feeder into the cavity in a state in which the feeder is moved forward up to above the cavity by the third cam driving system. Then an overfill operation is carried out. Specifically, the die is raised relative to the lower punch by the first cam driving system and thereafter the die is lowered relative to the lower punch to stop temporarily. The relative lowering and stopping operation of the die with respect to the lower punch is forcibly carried out, for example, in such a manner that the contact member is brought into contact with the stopper during the downward motion of the stopper by the fourth cam driving system. Then the feeder is moved backward away from the cavity by the third cam driving system and thereafter an underfill operation is carried out. Specifically, the die is slightly raised relative to the lower punch. The relative raising operation of the die with respect to the lower punch is forcibly carried out, for example, in such a manner that the contact member is kept in contact with the stopper during the upward motion of the stopper by the fourth cam driving system. Then the upper punch is lowered by the second cam driving system to compact the raw powder by the upper punch and the lower punch, thereby obtaining the molded article. Thereafter, the die is lowered relative to the lower punch by the first cam driving system to push out the molded article.

Incidentally, as far as the rotating speed of the cam is not so high, it is possible to carry out the aforementioned overfill and underfill operations by means of the first cam driving system only. However, where the rotating speed of the cam is raised in order to increase efficiency of production of the molded article, the die will overshoot by virtue of the inertia if the relative motions of the die with respect to the lower punch vary continuously. For this reason, if the overfill and underfill operations are carried out by means of the first cam driving system only, the relative motions of the die with respect to the lower punch will fail to follow the motion of the first cam.

In contrast to it, the present invention adopts the following configuration: there are the contact member, stopper, and fourth cam driving system provided, and during the overfill and underfill operations, the contact member is in contact with the stopper whereby, for example, the die is forcibly lowered, stopped, and raised in accordance with the motion of the fourth cam of the fourth cam driving system. For this reason, the die will rarely overshoot even if the relative motions of the die with respect to the lower punch vary continuously at high speed. As a result, the overfill and underfill operations can be carried out in succession while the first cam, the second cam, the third cam, and the fourth cam are rotated at high speed.

Preferably, the molding apparatus further comprises means for adjusting a height position of the contact member or the stopper. When the height position of the contact member or the stopper is changed, the distance varies between the contact member and the stopper. This changes the timing to regulate the relative vertical movement of the die with respect to the lower punch, and a relative displacement amount of the die with respect to the lower punch, so as to change a filling amount of the powder into the cavity. Therefore, the filling amount of the powder into the cavity can be adjusted by adjusting the height position of the contact member or the stopper.

Preferably, the drive synchronizing means has a main shaft coupled to the first cam, the second cam, the third cam, and the fourth cam, and a drive motor for rotating the main shaft. In this case, the first cam, the second cam, the third cam, and the fourth cam are rotated in synchronism by simply rotating the main shaft by the drive motor. Therefore, the drive synchronizing means can be realized in the simple structure and at low cost.

Preferably, the first cam has such a shape as to sequentially raise, stop, lower, and stop the die relative to the lower punch, in a predetermined angular range; the fourth cam has such a shape as to sequentially lower, stop, and raise the stopper, in the predetermined angular range; the stopper is located above the contact member; the contact member and the stopper regulate relative upward movement of the die with respect to the lower punch in such a manner as to first raise and stop the die relative to the lower punch in accordance with movement of the first cam, subsequently lower, stop, and raise the die relative to the lower punch in accordance with movement of the fourth cam, and then stop the die relative to the lower punch in accordance with movement of the first cam. In this case, the overfill and underfill operations can be carried out securely in succession during one rotation of the first cam, the second cam, the third cam, and the fourth cam at high speed.

The present invention permits the molding apparatus to perform the continuous overfill and underfill operations even at high speed. This enables high-quality molded articles to be efficiently produced with little variation in dimensions and others.

The present invention will become more fully understood from the detailed description given hereinbelow and the accompanying drawings which are given by way of illustration only, and thus are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DESCRIPTION OF THE PREFERRED EMBODIMENTS

The preferred embodiments of the molding apparatus according to the present invention will be described below in detail with reference to the drawings.

Figure 1:
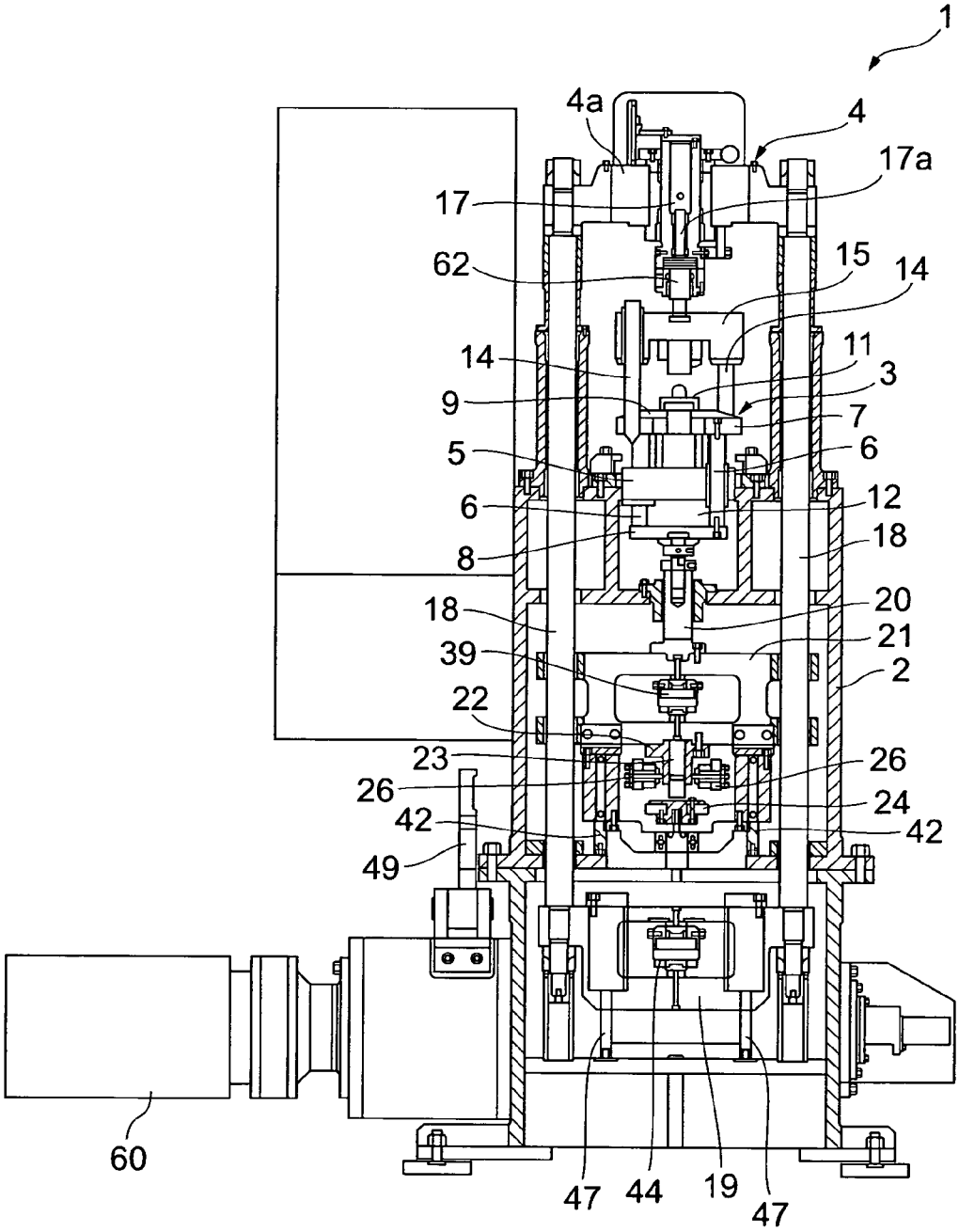
FIG. 1 is a sectional view of an embodiment of the molding apparatus according to the present invention, as a front view thereof.
Figure 2:
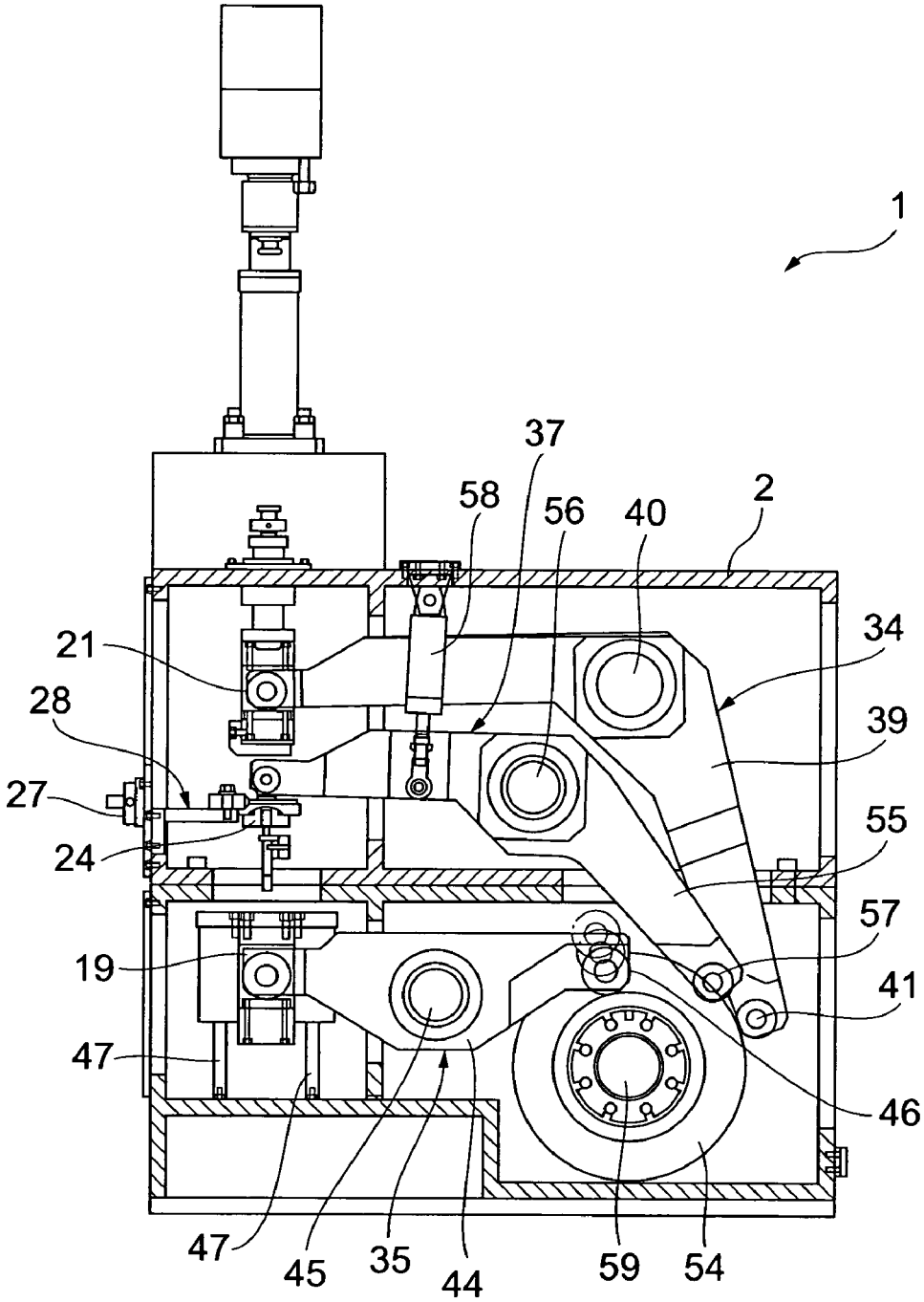
FIG. 2 is a sectional view of the molding apparatus shown in FIG. 1, as a side view.
Figure 3:
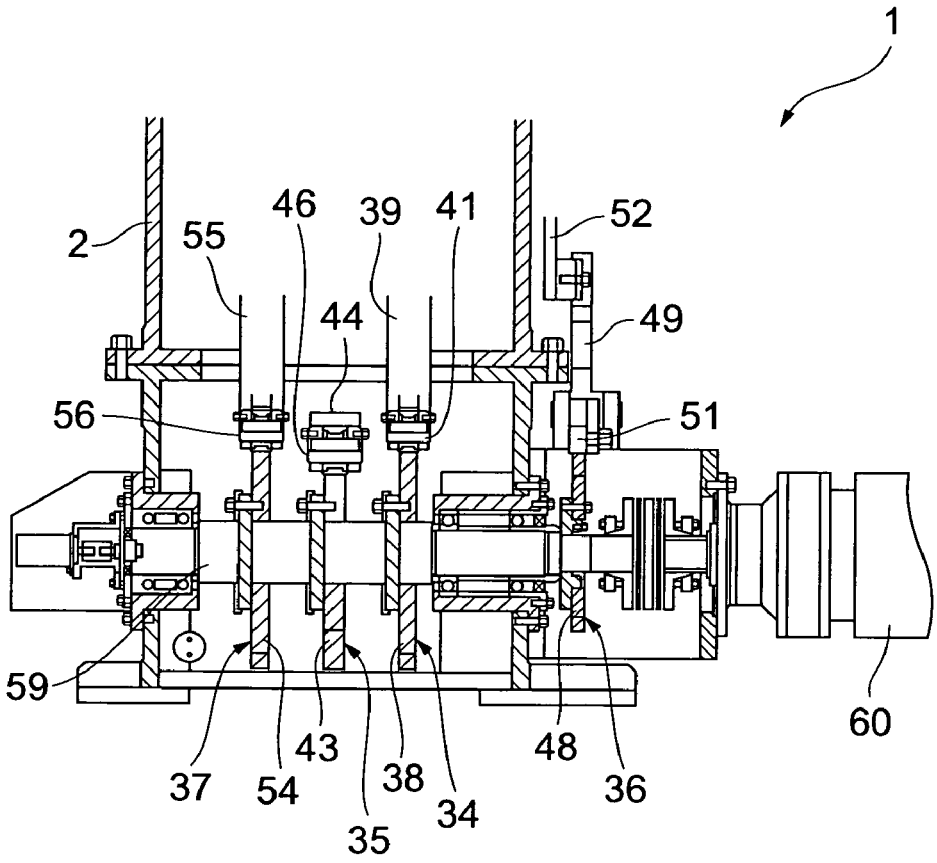
FIG. 3 is a sectional view of the molding apparatus shown in FIG. 1, as a top plan view.

FIG. 1 is a sectional view of an embodiment of the molding apparatus according to the present invention, as viewed from the front. FIG. 2 is a sectional view of the molding apparatus shown in FIG. 1, as viewed from the side. FIG. 3 is a sectional view of a cam part of the molding apparatus shown in FIG. 1, as viewed from the top. In each of the drawings, the molding apparatus 1 of the present embodiment is a cam press machine for compacting a powder of a material, such as a powder of a magnetic material or a powder of a dielectric material, into a predetermined shape (e.g., a rectangular parallelepiped shape). The molding apparatus 1 has a frame 2, a die set (lower ram) 3 installed in the upper portion of this frame 2, and an upper ram 4 located above the die set 3.

Figure 4:
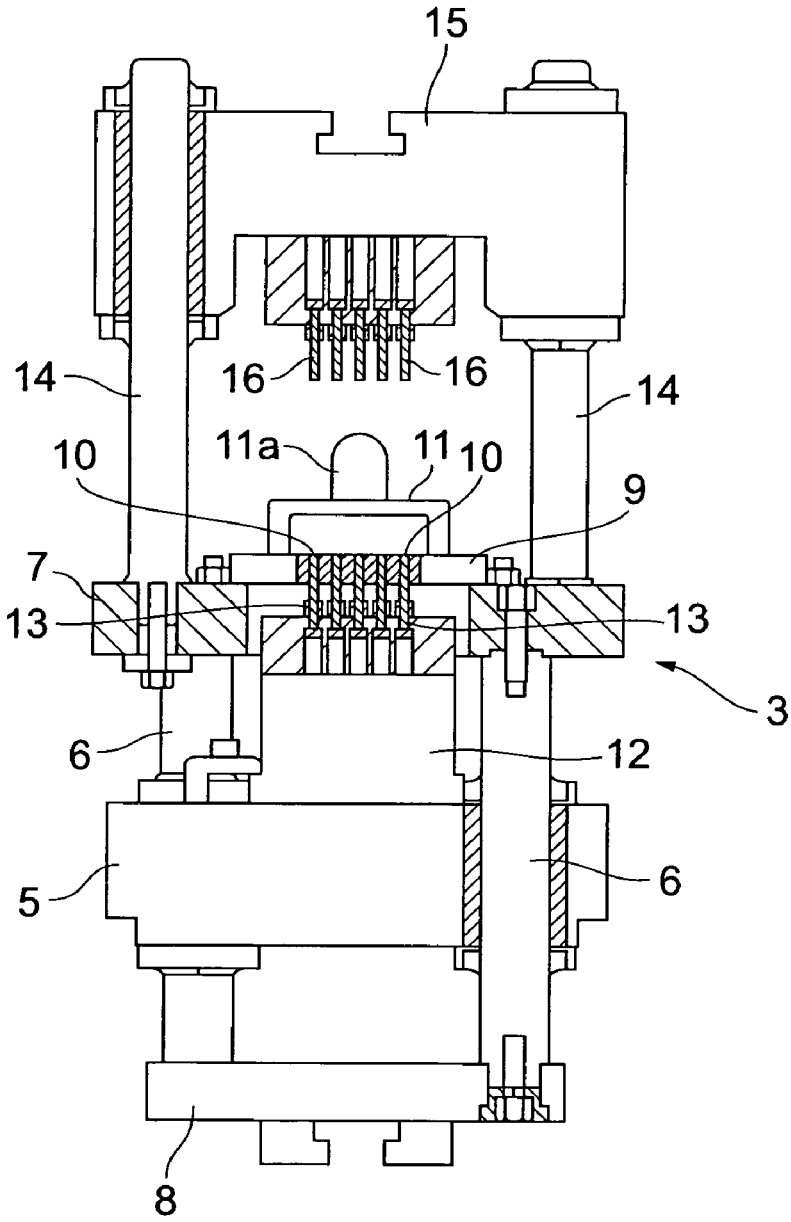
FIG. 4 is a front view of a die set shown in FIG. 1 (including cross sections in part).

The die set 3, as shown in FIG. 4, has a fixed plate 5 fixed to the frame 2. Two rods 6 extending vertically penetrate the fixed plate 5 so as to be slidable. A base 7 is fixed to the upper end of each rod 6 and a connection plate 8 is fixed to the lower end of each rod 6. A die 9 is mounted on the base 7. There are a plurality of cavities 10 (five cavities herein) formed in the die 9, and the cavities 10 penetrate the die 9 vertically and are to be filled with the material powder. A feeder 11 is provided on the die 9 so that it can freely move in cross directions (directions normal to the plane of FIG. 4). The feeder 11 has a feeder cup 11*a* for supplying the material powder into each cavity 10. A projection 12 is disposed on the fixed plate 5. A plurality of lower punches 13 (five lower punches herein) to be inserted into the respective cavities 10 from the lower side of the die 9 are fixed to the upper portion of the projection 12.

Two vertically extending rods 14 are arranged on both sides of the die 9 while standing upright on the base 7. These rods 14 slidably penetrate an elevator 15 forming a part of the upper ram 4. The elevator 15 is provided with a plurality of upper punches 16 (five upper punches herein) to be inserted into the respective cavities 10 from the upper side of the die 9. Each upper punch 16 cooperates with the counter lower punch 13 to compact the material powder filled in the cavity 10.

Returning to FIGS. 1 to 3, a ram body 4*a* is located above the elevator 15. This ram body 4*a* is provided with a pressurizing air cylinder 17. The ram body 4*a* is connected through two vertically extending rods 18 to a frame body 19 located in the lower portion of the frame 2.

A frame body 21 is connected through a connecting member 20 to the connection plate 8 of the die set 3. Each rod 18 slidably penetrates the frame body 21. A nut portion 22 is fixed to the lower portion of the frame body 21. An adjustment screw 23 is screwed into the nut portion 22. A contact member 24 is fixed to the lower end of the adjustment screw 23. A pad plate 25 is provided at the top portion of the contact member 24 (cf. FIG. 5). Two stoppers 26 to engage the pad plate 25 are arranged with the adjustment screw 23 in between, above the contact member 24. The contact member 24 and each of the stoppers 26 function to regulate upward movement of the die 9.

Figure 5:
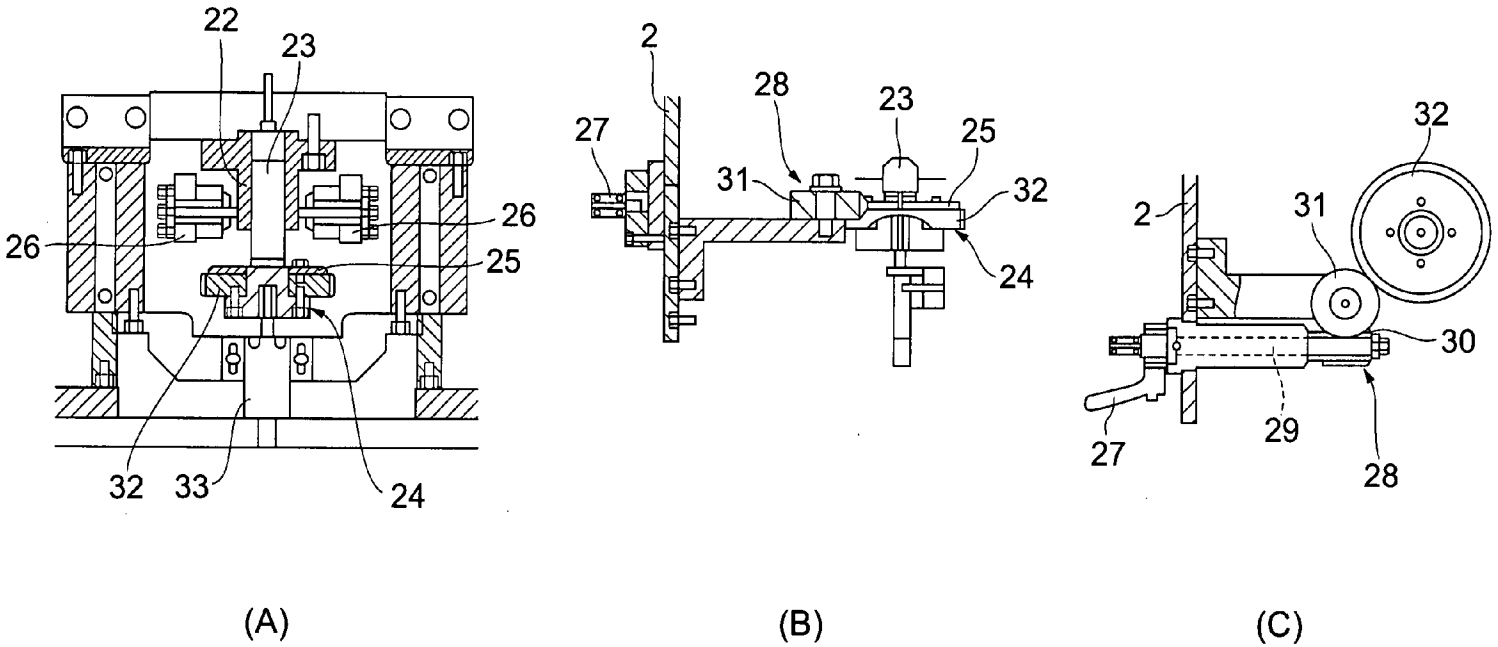
FIG. 5 is sectional views showing an adjustment handle and an adjusting mechanism shown in FIGS. 1 to 3.

The height position of the contact member 24 is adjustable by means of an adjustment handle 27 and an adjusting mechanism 28 disposed in the front end portion of the frame 2. The adjusting mechanism 28, as shown in FIG. 5, has an adjustment shaft 29 connected to the adjustment handle 27. A worm gear 30 is attached to the tip of the adjustment shaft 29. The worm gear 30 meshes with a spur gear 32 attached to the contact member 24, through an intermediate gear 31.

As the adjustment handle 27 is rotated, the contact member 24 rotates through the adjustment shaft 29, worm gear 30, intermediate gear 31, and spur gear 32. With the rotation of the contact member 24, the adjustment screw 23 vertically moves while being screwed relative to the nut portion 22. This varies the height position of the contact member 24. As the height position of the contact member 24 varies in this manner, the distance changes between the contact member 24 and the stoppers 26 and it results in changing a moving distance before contact of the pad plate 25 with the stoppers 26. A scale 33 for monitoring the moving distance of the contact member 24 to the stoppers 26 is provided below the contact member 24.

The molding apparatus 1 further comprises a die driving system 34, an upper ram driving system 35, a feeder driving system 36, and a stopper driving system 37. The die driving system 34 vertically moves the die 9. The upper ram driving system 35 vertically moves the upper ram 4. The feeder driving system 36 anteroposteriorly (laterally) moves the feeder 11. The stopper driving system 37 vertically moves each stopper 26.

Figure 6:
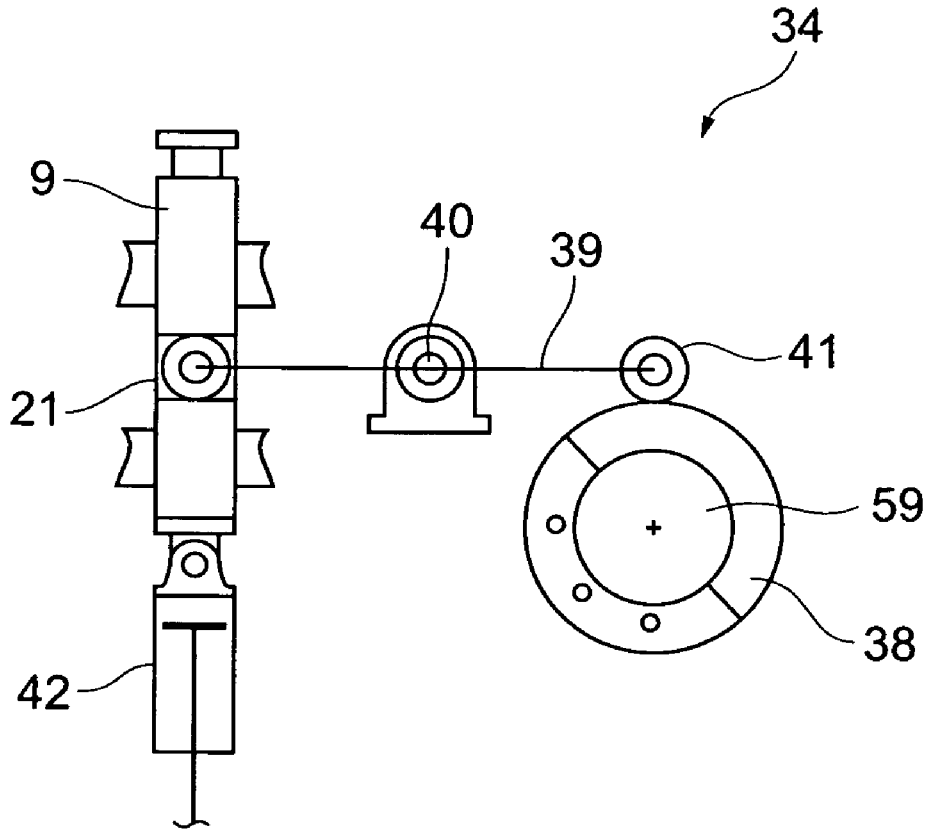
FIG. 6 is a conceptual diagram of a die driving system including a die driving cam shown in FIGS. 1 to 3.

The die driving system 34, as also shown in FIG. 6, has a die drive cam 38 and a lever 39. The lever 39 is journaled on a shaft part 40 provided on the frame 2. A cam follower 41 in direct contact with the die drive cam 38 is provided at the base end of the lever 39. The tip portion of the lever 39 is connected so as to be rotatable relative to the frame body 21. Two air cylinders 42 are provided between the frame body 21 and the frame 2. These air cylinders 42 prevent the cam follower 41 from disengaging from the die drive cam 38 during rotation of the die drive cam 38.

Figure 7:
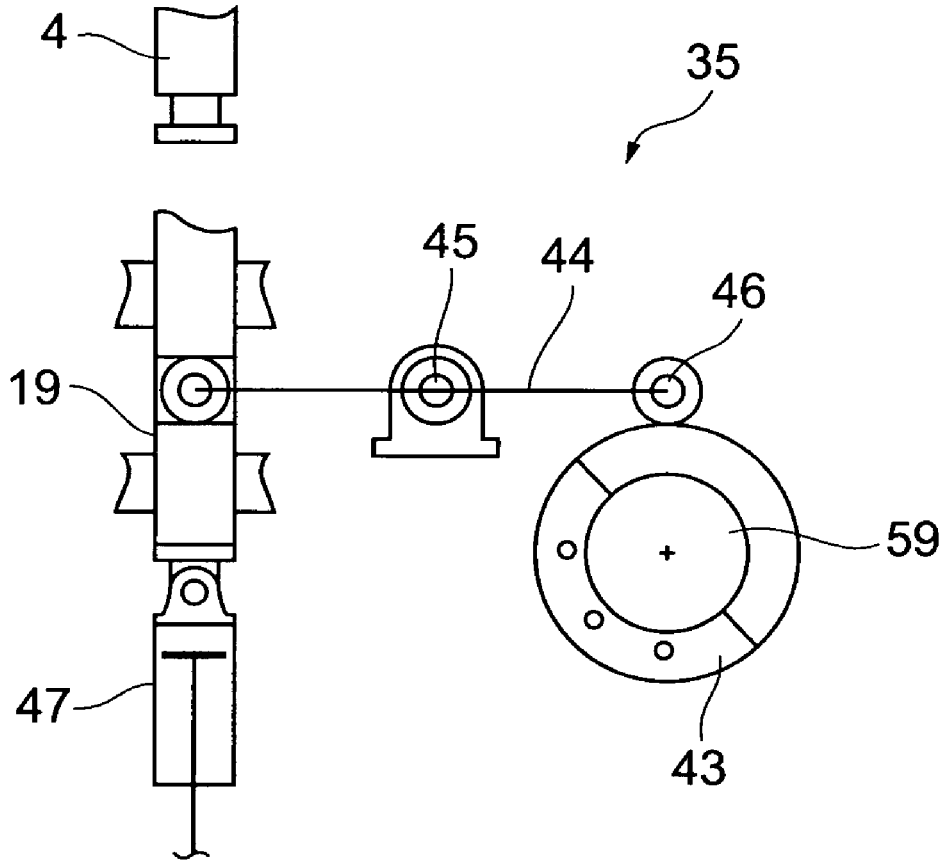
FIG. 7 is a conceptual diagram of an upper ram driving system including an upper ram driving cam shown in FIGS. 1 to 3.
Figure 8:
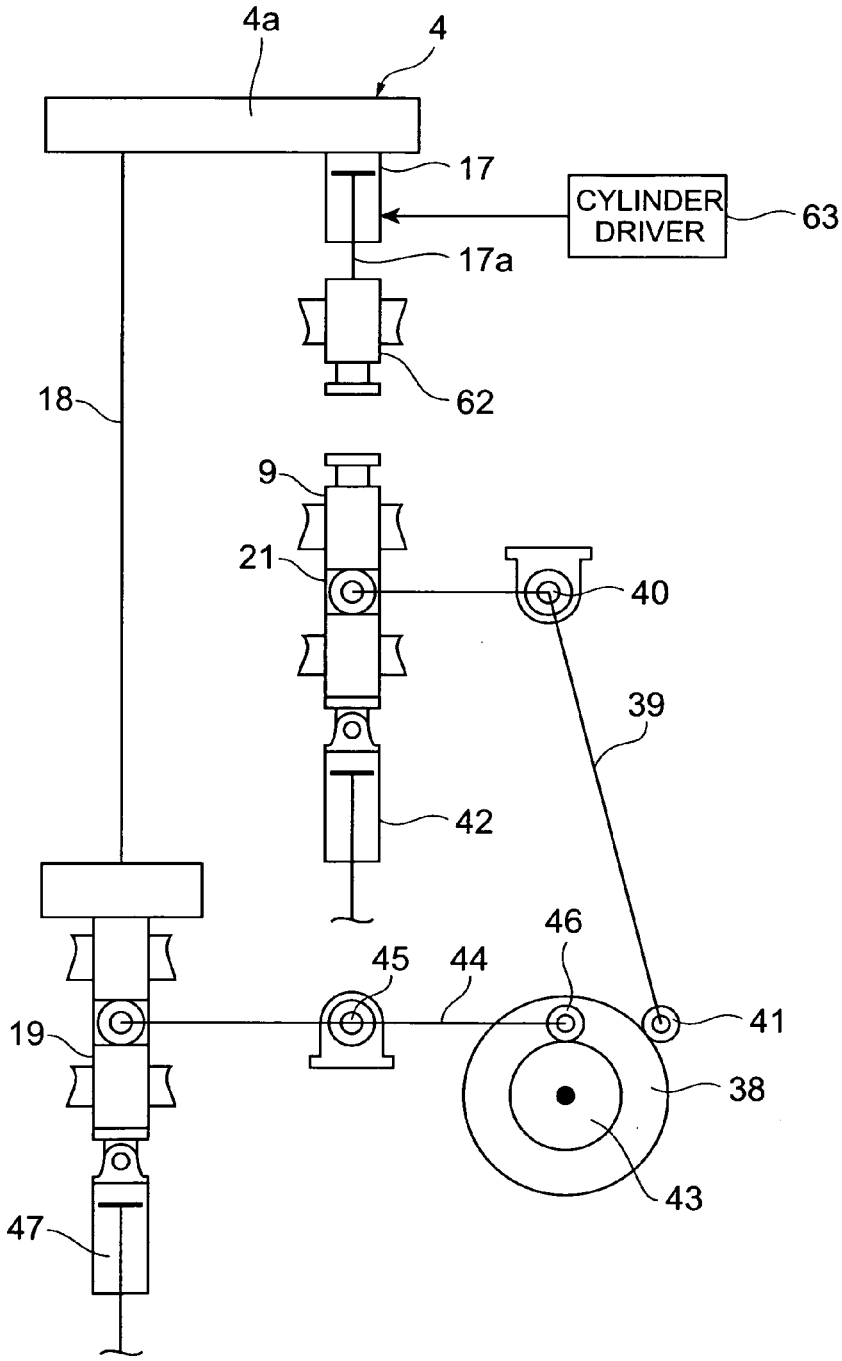
FIG. 8 is a conceptual diagram collectively showing a feeder driving system and a pressurizing air cylinder driving system including the die driving cam and the upper ram driving cam shown in FIGS. 1 to 3.

The upper ram driving system 35, as also shown in FIGS. 7 and 8, has an upper ram drive cam 43 and a lever 44. The lever 44 is journaled on a shaft part 45 provided on the frame 2. A cam follower 46 in direct contact with the upper ram drive cam 43 is provided at the base end of the lever 44. The tip portion of the lever 44 is connected so as to be rotatable relative to the frame body 19. Four air cylinders 47 are provided between the frame body 19 and the frame 2. These air cylinders 47 prevent the cam follower 46 from disengaging from the upper ram drive cam 43 during rotation of the upper ram drive cam 43.

The pressurizing air cylinder 17 (described previously) is attached to the ram body 4*a* of the upper ram 4. A piston rod 17*a* of the pressurizing air cylinder 17 is fixed through a connecting member 62 to the elevator 15 (cf. FIG. 1). This results in connecting the piston rod 17*a* to each upper punch 16 through the connecting member 62 and the elevator 15. The pressurizing air cylinder 17 is driven by a cylinder driver 63 having an air pressure source and an air valve. The cylinder driver 63 performs such control as to drive the pressurizing air cylinder 17, after completion of compression and pressure holding operation (described later) by the upper punches 16 and lower punches 13. The pressurizing air cylinder 17 may be an air cylinder with a locking function, and the locking function is released only during driving.

Figure 9:
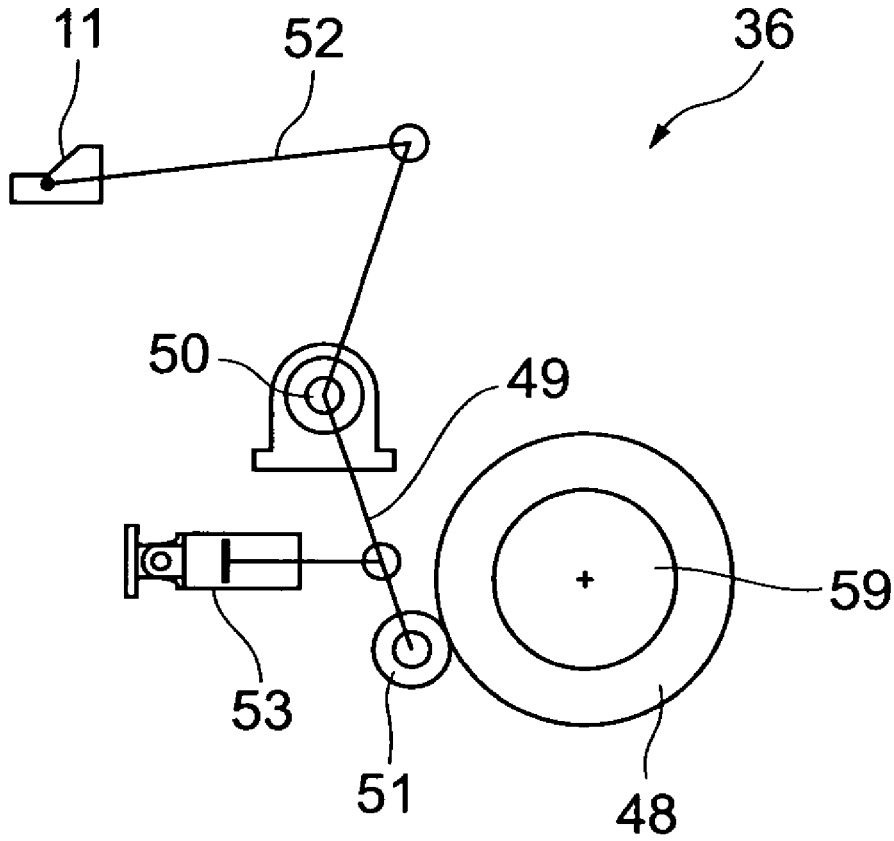
FIG. 9 is a conceptual diagram of the feeder driving system including a feeder driving cam shown in FIGS. 1 to 3.

The feeder driving system 36, as also shown in FIG. 9, has a feeder drive cam 48 and a lever 49. The lever 49 is journaled on a shaft part 50 provided on the frame 2. A cam follower 51 in direct contact with the feeder drive cam 48 is provided at the base end of the lever 49. The tip portion of the lever 49 is connected to a link 52 connected to the feeder 11. An air cylinder 53 is provided between the lever 49 and the frame 2. The air cylinder 53 prevents the cam follower 51 from disengaging from the feeder drive cam 48 during rotation of the feeder drive cam 48.

Figure 10:
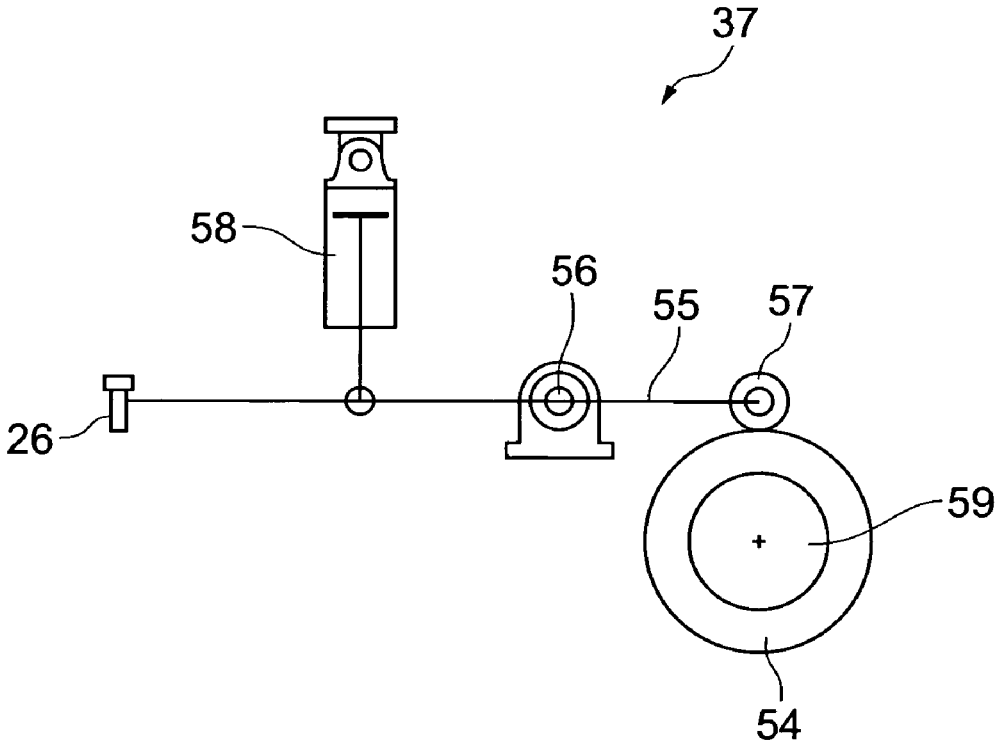
FIG. 10 is a conceptual diagram of a stopper driving system including a die regulating cam shown in FIGS. 1 to 3.

The stopper driving system 37, as also shown in FIG. 10, has a die regulating cam 54 and a lever 55. The lever 55 is journaled on a shaft part 56 provided on the frame 2. A cam follower 57 in direct contact with the die regulating cam 54 is provided at the base end of the lever 55. The tip portion of the lever 55 is connected to each stopper 26. An air cylinder 58 is provided between the lever 55 and the frame 2. The air cylinder 58 prevents the cam follower 57 from disengaging from the die regulating cam 54 during rotation of the die regulating cam 54.

The die drive cam 38, upper ram drive cam 43, feeder drive cam 48, and die regulating cam 54 are connected to a main shaft 59 located in the lower portion of the frame 2. The main shaft 59 is rotated by a drive motor 60. As the main shaft 59 is rotated by the drive motor 60, those cams 38, 43, 48, and 54 rotate in synchronization. The cams 38, 43, 48, and 54 are constructed, for example, of plate cams or split cams.

As the die drive cam 38 rotates with rotation of the main shaft 59, the lever 39 rocks, so that the frame body 21 vertically moves in a state in which each air cylinder 42 is reciprocating. The vertical motion of the frame body 21 results in vertically moving each rod 6 connected through the connecting member 20 to the frame body 21, and then vertically moving the die 9 relative to the lower punches 13 in conjunction therewith. As the upper ram drive cam 43 rotates with rotation of the main shaft 59, the lever 44 rocks, so that the frame body 19 vertically moves in a state in which each air cylinder 47 is reciprocating. The vertical motion of the frame body 19 results in vertically moving the upper ram 4 through each rod 18 connected to the frame body 19, and then vertically moving the upper punches 16 in conjunction therewith. As the feeder drive cam 48 rotates with rotation of the main shaft 59, the lever 49 rocks in a state in which the air cylinder 53 is reciprocating, and the feeder 11 anteroposteriorly moves on the die 9 through the link 52. As the die regulating cam 54 rotates with rotation of the main shaft 59, the lever 55 rocks in a state in which the air cylinder 58 is reciprocating, and each stopper 26 vertically moves.

Figure 11:
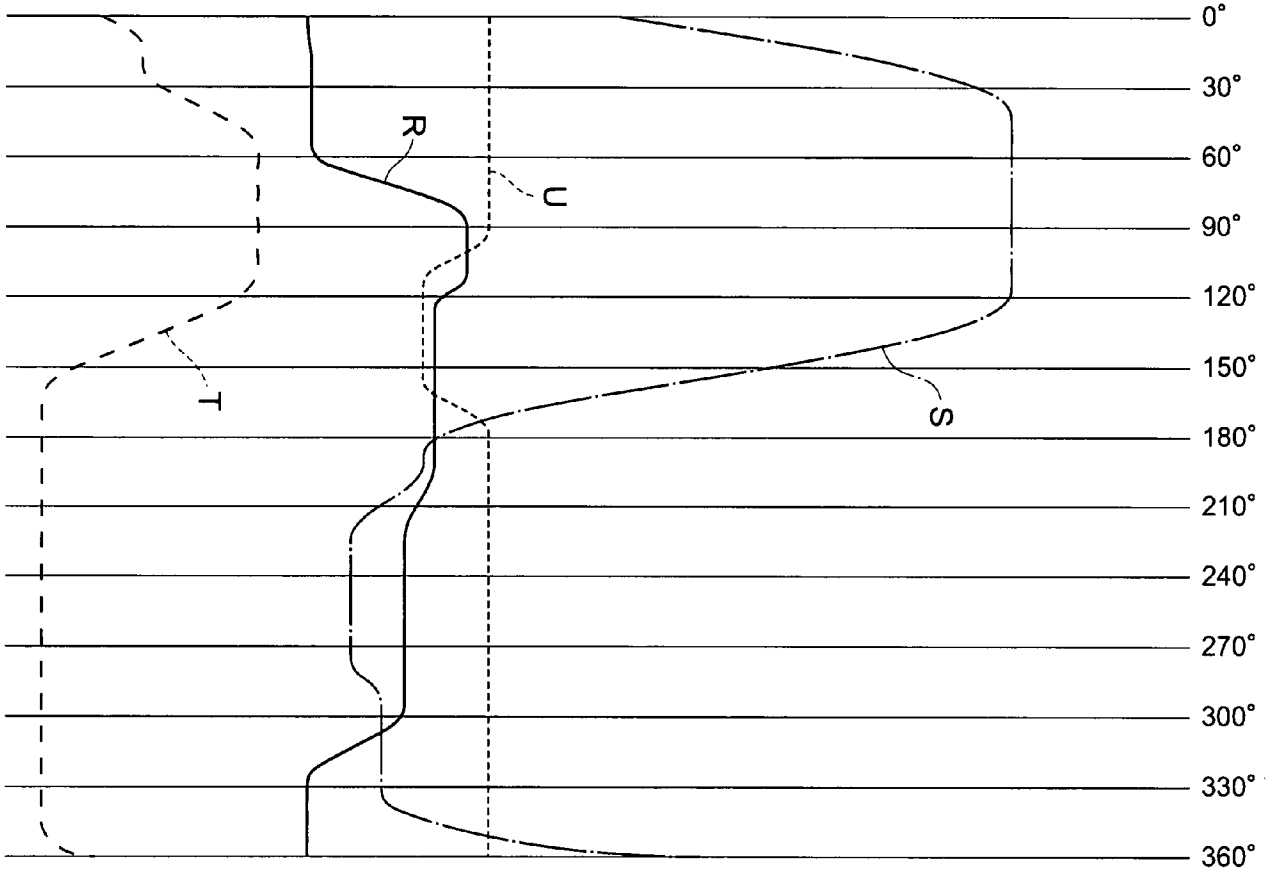
FIG. 11 is a cam curve diagram showing shapes of the die driving cam, die driving cam, feeder driving cam, and die regulating cam shown in FIGS. 1 to 3.

Shapes of the die drive cam 38, upper ram drive cam 43, feeder drive cam 48, and die regulating cam 54 are defined according to the cam curve diagram (diagram indicating motions of the cams) as shown in FIG. 11. The die drive cam 38 has a shape according to a cam curve R of a solid line shown in FIG. 11. The upper ram drive cam 43 has a shape according to a cam curve S of a chain line shown in FIG. 11. The feeder drive cam 48 has a shape according to a cam curve T of a coarsely dashed line shown in FIG. 11. The die regulating cam 54 has a shape according to a cam curve U of a densely dashed line shown in FIG. 11. The horizontal axis of FIG. 11 represents angles of rotation from a reference position (0°), and the vertical axis of FIG. 11 represents the height positions of the cams 38, 43, and 54 and the anteroposterior position of the cam 48. The scale of the cam curves of the cams 38, 43, and 54 is different from that of the cam curve of the cam 48.

Specifically, the die drive cam 38 has such a shape as to finely raise the die 9 from its initial height position in a region of about 10° to 20° with respect to the reference position, stop the die 9 in a region of about 20° to 55°, raise the die 9 in a region of about 55° to 90°, stop the die 9 in a region of about 90° to 110°, slightly lower the die 9 in a region of about 110° to 125°, stop the die 9 in a region of about 125° to 190°, slightly lower the die 9 in a region of about 190° to 220°, stop the die 9 in a region of about 220° to 295°, lower the die 9 to the initial height position in a region of about 295° to 330°, and stop the die 9 in a region from about 330° to the reference position.

Figure 12:
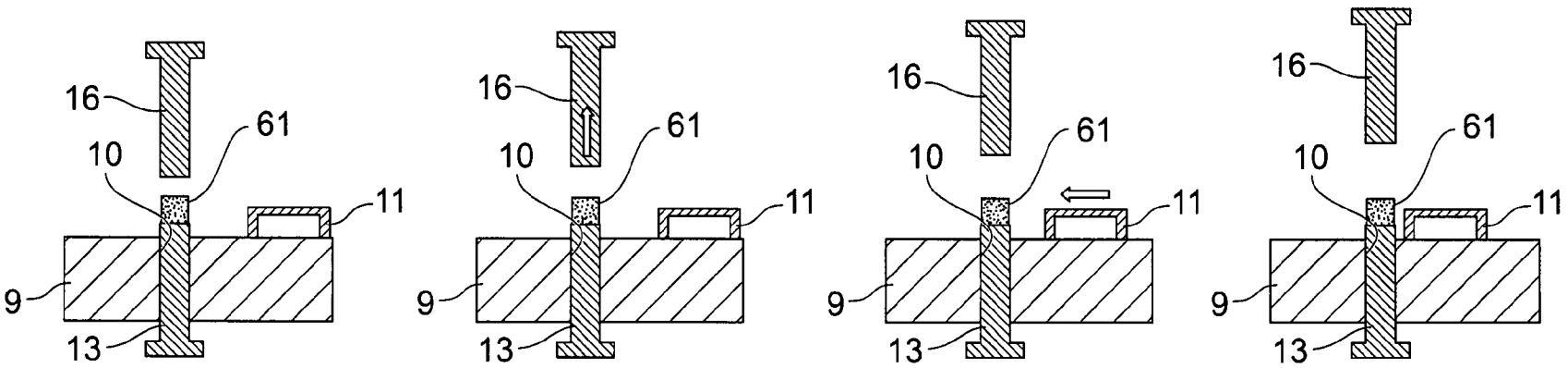
FIGS. 12 to 16 are step diagrams showing a procedure of performing molding by means of the molding apparatus shown in FIGS. 1 to 3.
Figure 13:
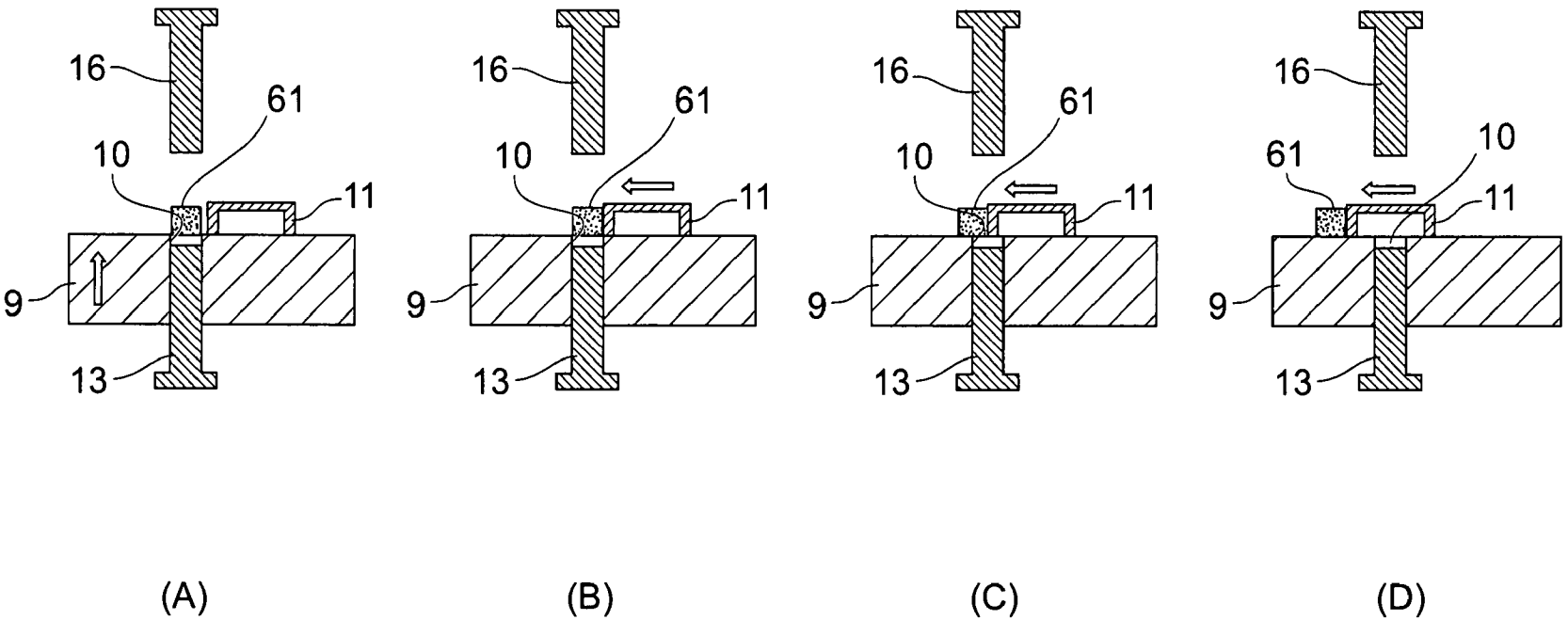
Figure 14:
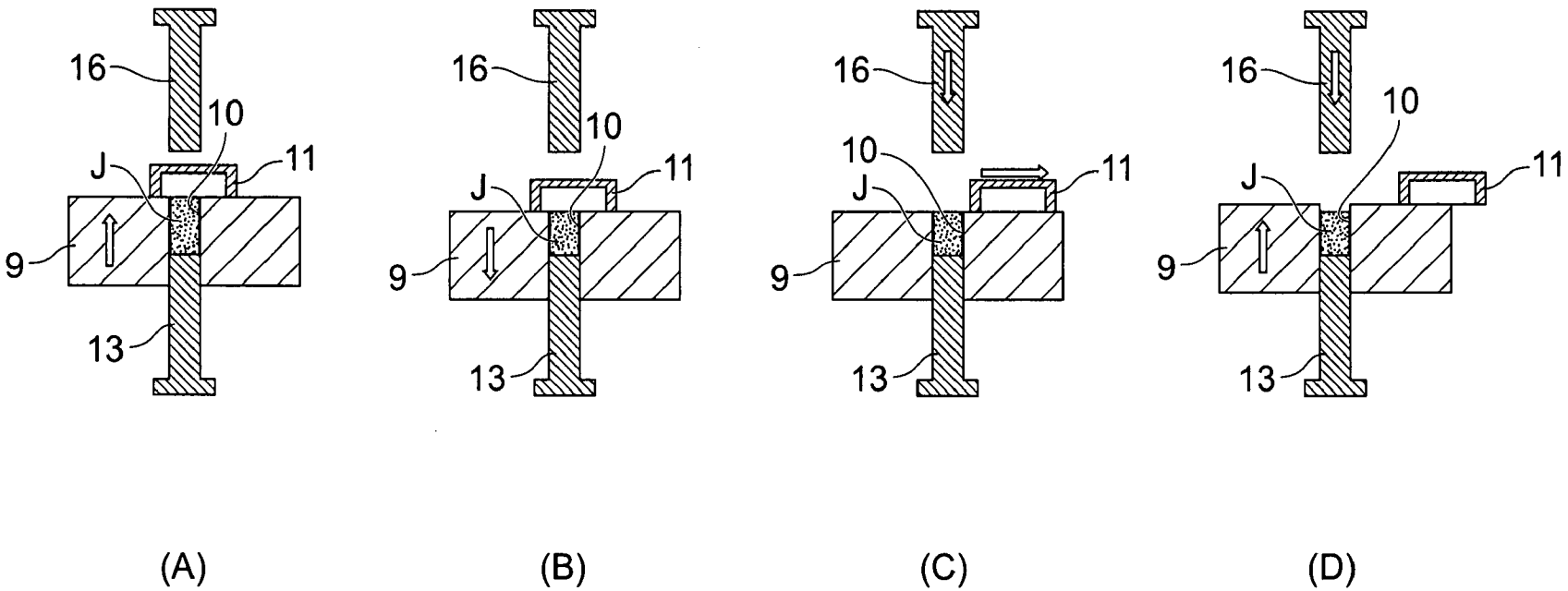
Figure 15:
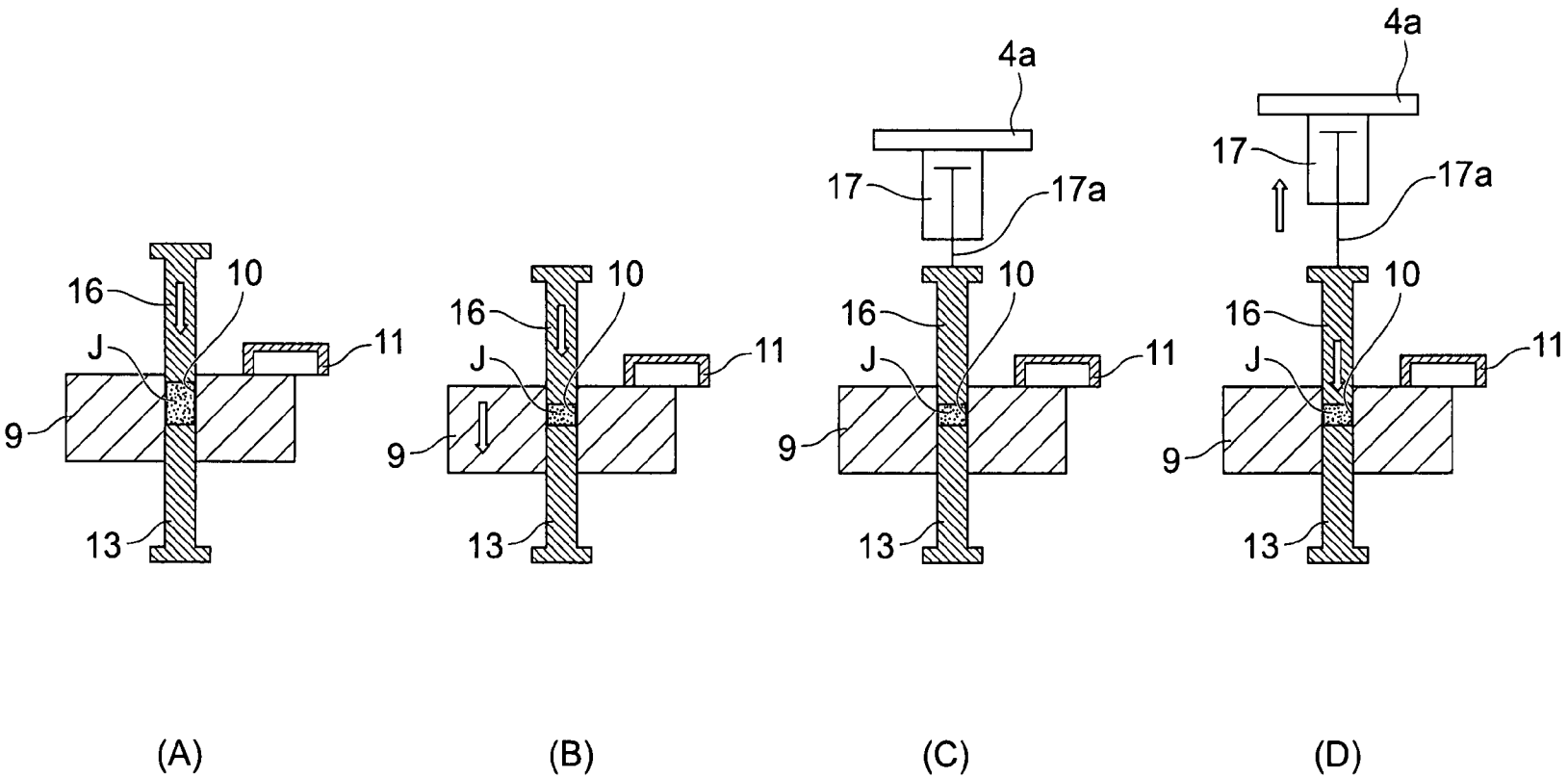
Figure 16:
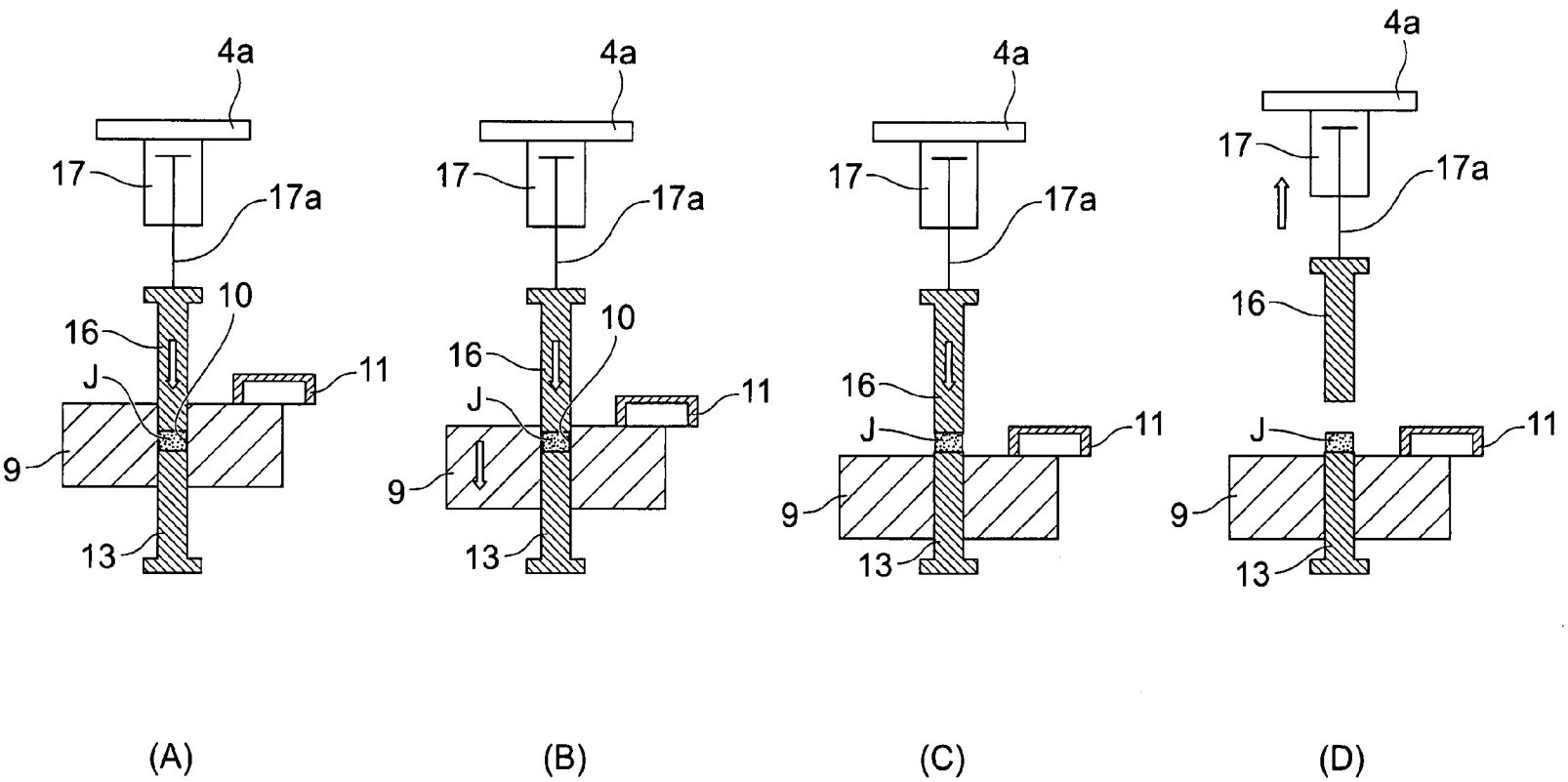

The initial height position of the die 9 is such a height position that the upper ends of the lower punches 13 put into the cavities 10 slightly project out from the upper surface of the die 9, as shown in FIG. 12. The die driving system 34 is configured, as shown in FIG. 13, so that when the die drive cam 38 finely raises the die 9 from the initial height position in the region of about 10° to 20° with respect to the reference position, the upper ends of the lower punches 13 move into the cavities 10.

The upper ram drive cam 43 has such a shape as to fully raise the upper punches 16 from its initial height position in a region from the reference position to 45°, stop the upper punches 16 in a region of about 45° to 115°, fully lower the upper punches 16 in a region of about 115° to 190°, stop the upper punches 16 in a region of around 190°, further lower the upper punches 16 in a region of about 190° to 225°, stop the upper punches 16 in a region of about 225° to 275°, slightly raise the upper punches 16 in a region of about 275° to 295°, stop the upper punches 16 in a region of about 295° to 330°, and raise the upper punches 16 to the initial height position in a region from about 330° to the reference position.

The feeder drive cam 48 has such a shape as to move the feeder 11 forward from its initial position in a region from the reference position to about 15°, stop the feeder 11 in a region of about 15° to 25°, further move the feeder 11 forward in a region of about 25° to 60°, repeat fine forward and backward motions of the feeder 11 in a region of about 60° to 105°, fully move the feeder 11 backward in a region of about 105° to 165°, stop the feeder 11 in a region of about 165° to 345°, and move the feeder 11 forward to the initial position in a region from about 345° to the reference position.

The feeder driving system 36 is configured, as shown in FIG. 12 (D), so that when the feeder drive cam 48 rotates about 15°-25° from the reference position, the feeder 11 stops just before the cavities 10.

The die regulating cam 54 has such a shape as to stop the stoppers 26 at their initial height position in a region from the reference position to 90°, lower the stoppers 26 in a region of about 90° to 115°, stop the stoppers 26 in a region of about 115° to 155°, raise the stoppers 26 to the initial height position in a region of about 155° to 180°, and stop the stoppers 26 in a region from about 180° to the reference position.

Although the cams 38, 43, 48, and 54 are depicted in a circular shape as simplified in FIGS. 6 to 10, it is needless to mention that the actual shapes of the cams 38, 43, 48, and 54 are the special shapes including curve portions and straight portions.

Figure 17:
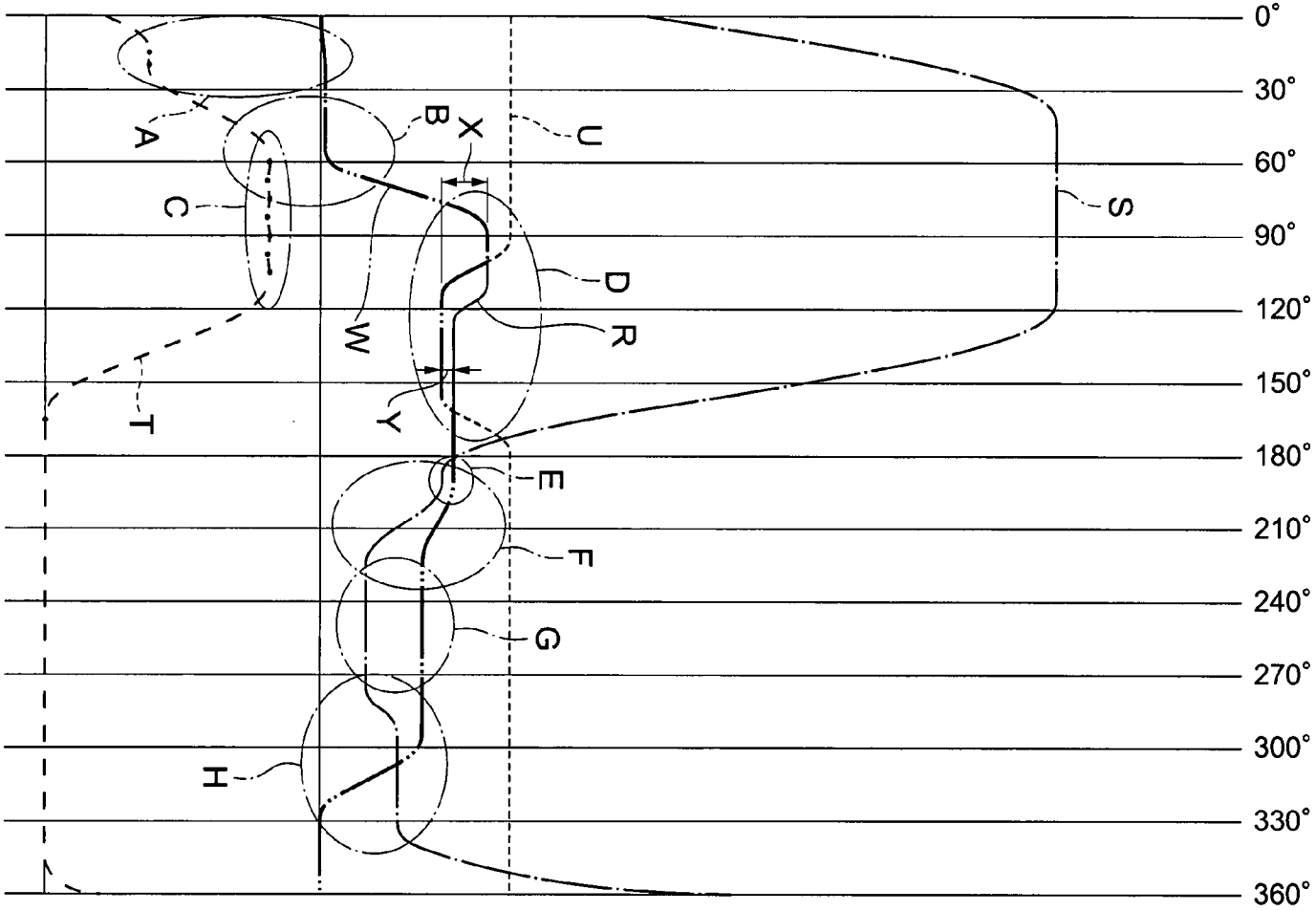
FIG. 17 is a diagram showing an actual operation of the die in the cam diagram shown in FIG. 11.

Next, a procedure of performing molding by means of the molding apparatus 1 constructed as described above will be described based on FIGS. 12 to 17. FIG. 17 is a diagram showing the actual operation of the die 9 by a chain double-dashed line W in the cam curve diagram shown in FIG. 11.

It is assumed herein that the height position of the contact member 24 is preliminarily adjusted by the adjustment handle 27 so that the pad plate 25 of the contact member 24 butts the stoppers 26 at a point of about 100° rotation of the main shaft 59 (cams 38, 43, 48, and 54) from the reference position (cf. FIGS. 11 and 17). Compacts are made every cycle of a rotation of cams 38, 43, 48, and 54.

In a state in which the cams 38, 43, 48, and 54 are at the reference position, as shown in FIG. 12 (A), the die 9, upper punches 16, feeder 11, and stoppers 26 are located at the initial setting position where compacts 61 obtained in a previous cycle are pushed out of the die 9. Namely, the die 9 is located at such a height position that the upper ends of the lower punches 13 put into the cavities 10 slightly project out from the upper surface of the die 9. This makes it possible to readily and securely take out the compacts 61 obtained in the previous cycle, from the cavities 10. The upper punches 16 are located at a height position a predetermined distance apart from the die 9. The feeder 11 is located at a position a predetermined distance away backward from the cavities 10 on the die 9. The compacts 61 made in the previous cycle are mounted on the lower punches 13.

As the cams 38, 43, 48, and 54 start rotating from the initial state in the predetermined direction, the upper punches 16 rise as shown in FIG. 12(B) and the feeder 11 moves forward toward the cavities 10 on the die 9 as shown in FIG. 12(C). As the cams 38, 43, 48, and 54 are further rotated, the feeder 11 temporarily stops just before the cavities 10, as shown in FIG. 12(D), and the die 9 is raised a little, as shown in FIG. 13(A), to pull the upper ends of the lower punches 13 slightly into the cavities 10 (cf. A in FIG. 17).

This prevents the feeder 11 from touching the compacts 61 and the upper ends of the lower punches 13, and thus can prevent damage to the compacts 61 and lower punches 13. After the compacts 61 are pushed out of the cavities 10, the compacts 61 swell by virtue of a spring back phenomenon. Therefore, even after the upper ends of the lower punches 13 are pulled into the cavities 10, the compacts 61 are kept from returning into the cavities 10 in accordance with the operation of the lower punches 13, and the compacts 61 are thus left as mounted over the cavities 10 on the die 9.

With further rotation of the cams 38, 43, 48, and 54, as shown in FIGS. 13(B) and (C), the feeder 11 again moves forward on the die 9 to push the compacts 61 made in the previous cycle. Since at this time the lower punches 13 are kept below the upper surface of the die 9, the feeder 11 will never collide with the lower punches 13. Since the feeder 11 is arranged to temporarily stop immediately before contact with the compacts 61 as described above, the speed of the feeder 11 is fully kept down upon contact with the compacts 61 after resumption of forward movement of the feeder 11. For this reason, the feeder 11 imposes no excess impact on the compacts 61 and the feeder 11 smoothly pushes the compacts 61. This can prevent damage to the compacts 61 or the like.

As the cams 38, 43, 48, and 54 are further rotated in the same direction, as shown in FIG. 13(D), the feeder 11 further moves forward on the die 9 to move the compacts 61 away from the cavities 10. Then the feeder 11 stops at the position where it covers the cavities 10 (cf. B in FIG. 17). Since the cavities 10 are constantly covered by the compacts 61 and feeder 11 in this manner, little air enters the cavities 10.

As the cams 38, 43, 48, and 54 are further rotated in the same direction, as shown in FIG. 14(A), the die 9 is raised to a predetermined height position and the material powder J is drawn and filled from the feeder 11 into the cavities 10 (cf. B in FIG. 17). Since at this time the feeder 11 is kept at a standstill, the material powder J is supplied straight down into the cavities 10. In addition thereto, the feeder 11 is continuously subjected to shaking operation, i.e., fine forward and backward motions of the feeder 11 (cf. C in FIG. 17). Therefore, it is feasible to efficiently and uniformly fill the material powder J into the cavities 10.

As the cams 38, 43, 48, and 54 are further rotated in the same direction, the stoppers 26 are lowered. Since at this time the die 9 is at a standstill, the stoppers 26 come to butt the contact member 24. For this reason, the die 9 is switched from the operation according to the motion of the die drive cam 38, into an operation according to the motion of the die regulating cam 54. Therefore, as shown in FIG. 14(B), the die 9 is lowered according to the downward motion of the stoppers 26 in a state in which the contact member 24 butts the stoppers 26. This carries out an overfill operation of the material powder J (cf. D in FIG. 17).

The overfill operation is a filling operation to fill the material powder J in a state in which a powder fill depth of the cavities 10 is preliminarily kept large, thereafter lower the die 9 so as to slightly decrease the powder fill depth of the cavities 10, and push an excess amount of the material powder J back to the feeder 11. An overfill amount corresponds to a lowered distance X of the die 9 at that time (cf. FIG. 17). By executing this overfill operation, it becomes feasible to reduce voids upon filing of the material powder J into the cavities 10 and to densely fill the material powder J into the cavities 10.

As the cams 38, 43, 48, and 54 are further rotated in the same direction, as shown in FIG. 14(C), the feeder 11 moves backward away from the cavities 10, thereby performing a striking operation of the material powder J. Furthermore, the upper punches 16 start to be lowered.

Then the stoppers 26 begin to be raised after a lapse of a predetermined time, whereupon the die 9 is raised while the contact member 24 is kept in contact with the stoppers 26, as shown in FIG. 14(D). The die regulating cam 54 is formed so that the stoppers 26 move away from the contact member 24 after a rise of a predetermined distance. For this reason, the die 9 returns from the operation according to the motion of the die regulating cam 54, again into the operation according to the motion of the die drive cam 38 to become at a standstill. This results in carrying out an underfill operation of the material powder J (cf. D in FIG. 17).

The underfill operation is a filling operation to raise the die 9 after completion of the filling of the material powder J into the cavities 10, and thereby to lower the material powder J below the upper surface of the die 9. An underfill amount corresponds to a rise distance Y of the die 9 at that time (cf. FIG. 17). By executing this underfill operation, the material powder J can be prevented from flowing over the cavities 10.

As the cams 38, 43, 48, and 54 are further rotated in the same direction, as shown in FIG. 15(A), the upper punches 16 enter the cavities 10 and then the upper punches 16 temporarily stop in a state in which the upper struck level of the material powder J coincides with the lower end faces of the upper punches 16 (cf. E in FIG. 17). At this time, since the aforementioned underfill operation creates a space in the upper portion of each cavity 10 (cf. FIG. 14(D)), it becomes easier for the upper punches 16 to enter the cavities 10.

As the cams 38, 43, 48, and 54 are further rotated in the same direction, as shown in FIG. 15(B), the die 9 is lowered while the upper punches 16 are also lowered, thereby effecting compacting of the material powder J by the upper punches 16 and the lower punches 13 (simultaneous pressing up and down) (cf. F in FIG. 17). At this time, it is desirable to set the lowering speed of the upper punches 16 larger than the lowering speed of the die 9.

As the cams 38, 43, 48, and 54 are further rotated in the same direction, as shown in FIG. 15(C), the die 9 and upper punches 16 both stop for a predetermined time to maintain the pressing state of the material powder J by the upper punches 16 and the lower punches 13 (pressing hold) (cf. G in FIG. 17). At this time, since the supply pressure of the pressurizing air cylinder 17 by the cylinder driver 63 is smaller than the compacting pressure by the upper punches 16 and the lower punches 13, the piston rod 17*a* of the pressurizing air cylinder 17 is in a most contracted state. The pressing hold time is desirably a time enough to stabilize the shape, size, etc. of the compacts obtained from the compacted material powder J.

As the cams 38, 43, 48, and 54 are further rotated in the same direction, as shown in FIG. 15(D), the pressing state switches from the pressing of the material powder (compacts) J by the upper punches 16 into pressing of the compacts J by the pressurizing air cylinder 17. Specifically, the upper ram 4 is slightly raised by the upper ram drive cam 43 (cf. H in FIG. 17). At this time, the pressurizing air cylinder 17 is driven by the cylinder driver 63 so as to urge the upper punches 16 under a predetermined pressure against the compacts J. Namely, the piston rod 17*a* of the pressurizing air cylinder 17 is expanded with the rise of the upper ram 4, so that the upper punches 16 may be kept at the same height position. By pressing the compacts J by the pressurizing air cylinder 17 in this manner, it becomes feasible to prevent damage to the compacts J or the like due to strain caused by the compacting of the material powder J.

As the cams 38, 43, 48, and 54 are further rotated in the same direction, as shown in FIG. 16(A), the rise operation of the upper ram 4 is stopped while the compacts J are continuously pressed by the pressurizing air cylinder 17. As the cams 38, 43, 48, and 54 are further rotated in the same direction, as shown in FIGS. 16(B) and (C), a hold down operation is carried out while the compacts J are further kept in the pressed state by the pressurizing air cylinder 17. Namely, the die 9 is lowered to the aforementioned initial setting position, whereby the compacts J are pushed out of the die 9 (cf. H in FIG. 17). At this time, the pressure exerted on the compacts J by the pressurizing air cylinder 17 (hold pressure) is a pressure smaller than the compacting pressure on the compacts J.

As the cams 38, 43, 48, and 54 are further rotated in the same direction, as shown in FIG. 16(D), the upper punches 16 are raised with a rise of the upper ram 4 to move away from the compacts J. The above completes one cycle of molding operation.

By stopping the rise operation of the upper ram 4 and carrying out the hold down operation while the upper punches 16 are pressed against the compacts J by the pressurizing air cylinder 17 as described above, it is feasible to suppress pressure variation due to expansion (displacement) of the piston rod 17*a* of the pressurizing air cylinder 17. For this reason, the hold pressure is stabilized, so that excellent moldability can be assured. As a result, without need for provision of a special complicated mechanism or for execution of cumbersome electric control, the compacts J can be securely pushed out from the cavities 10 of the die 9, while preventing damage to the compacts J or the like and keeping the hold pressure constant.

In the molding operation by the molding apparatus 1, where the height position of the contact member 24 is changed by the adjustment handle 27, the cam curve U of the die regulating cam 54 is vertically shifted on the cam curve diagram (cf. FIGS. 11 and 17), relative to the cam curve R indicating the motion of the die drive cam 38. This changes a displacement amount before the contact member 24 comes into contact with the stoppers 26, and, in other words, it changes the timing when the contact member 24 comes into contact with the stoppers 26. Since the shape of the cam curve U itself is kept unchanged, the change of the timing alters the displacement amount after the contact of the contact member 24 with the stoppers 26. Therefore, it changes the overfill amount (cf. X in FIG. 17) and the underfill amount (cf. Y in FIG. 17) at that time, so as to vary the filling amount of the material powder J into the cavities 10.

Incidentally, the rotating speed of the main shaft 59 (cams 38, 43, 48, 54) needs to be raised in order to increase the efficiency of production of compacts. At this time, where a time for one rotation of the main shaft 59 is set sufficiently short, e.g., about 0.75 sec (80 rpm), it is difficult to achieve the aforementioned operation of the die 9 by the die drive cam 38 only. The reason is that the downward and upward motions of the die 9 are continuously carried out within an extremely short time during the execution of the overfill operation shown in FIG. 14(B) and the underfill operation shown in FIG. 14(D) and thus high-speed rotation of the die drive cam 38 will result in causing wavelike shakes (overshoot) in the motions of the die 9. This overshoot results from the fact that the cam follower 41 leaves the die drive cam 38 at an unintended timing and the die 9 fails to follow the motion of the die drive cam 38.

The present embodiment is provided with the contact member 24 and stoppers 26 for regulating the upward movement of the die 9, and the stopper driving system 37 having the die regulating cam 54 for vertically moving the stoppers 26. The contact member 24 is kept in contact with the stoppers 26 during execution of the overfill operation and underfill operation, whereby the die 9 is forcibly lowered, stopped, and raised in accordance with the motion of the die regulating cam 54. Since the die 9 is moved up and down by the combination of the die drive cam 38 with the die regulating cam 54 as described above, the die 9 rarely overshoots even during rotation of the main shaft 59 at high speed, and the die 9 operates according to the preset motions. This allows the continuous overfill and underfill operations to be carried out at high speed in a cycle.

The present embodiment is provided with the adjustment handle 27 and the adjusting mechanism 28 for adjusting the height position of the contact member 24. By manually operating the adjustment handle 27, it is feasible to readily adjust the filling amount of the material powder J into the cavities 10.

The present invention is by no means limited to the above embodiment. For example, the above embodiment showed the molding form by the so-called withdrawal method of fixing the lower punches 13 to the frame 2 and vertically moving the die 9 relative to the frame 2, but the present invention is not limited to it. It is also possible to adopt a configuration wherein the die 9 is fixed to the frame 2 and wherein the lower punches 13 are vertically moved relative to the frame 2. The point is that the die 9 is arranged to be vertically movable relative to the lower punches 13.

The above embodiment is provided with the adjustment handle 27 and the adjusting mechanism 28 for adjusting the height position of the contact member 24, but the present invention is not limited to this. It is also possible to adjust the filling amount of the material powder J into the cavities 10, by adjusting the height position of the stoppers 26 instead of the contact member 24. The stoppers 26 may be located below the contact member 24 as long as the die 9 is operated so as to carry out the aforementioned overfill and underfill operations.

The above embodiment was arranged to fix the die drive cam 38, upper ram drive cam 43, feeder drive cam 48, and die regulating cam 54 to the main shaft 59 and to rotate the main shaft 59 by the drive motor 60, but the present invention is not limited to this. It is also possible to rotate the die drive cam 38, upper ram drive cam 43, feeder drive cam 48, and die regulating cam 54 by respective different drive motors. In this case, the drive motors need to be controlled so as to rotate these cams 38, 43, 48, and 54 in synchronism.

The molding apparatus 1 of the above embodiment is provided with a plurality of cavities 10 formed in the die 9 and with a plurality of upper punches 16 and lower punches 13 corresponding thereto, but the present invention is not limited to this. It is needless to mention that the present invention is also applicable to a molding apparatus provided with an upper punch 16 and lower punch 13 one each.

From the invention thus described, it will be obvious that the invention may be varied in many ways. Such variations are not to be regarded as a departure from the spirit and scope of the invention, and all such modifications as would be obvious to one skilled in the art are intended for inclusion within the scope of the following claims.

What is claimed is:

1. A molding apparatus for compacting a powder into a predetermined shape, comprising:

a die having a cavity into which the powder is filled;

a lower punch arranged to be inserted into the cavity from a lower side of the die;

an upper punch arranged to be inserted into the cavity from an upper side of the die to compact the powder filled in the cavity, in cooperation with the lower punch;

a feeder for feeding the powder into the cavity;

a first cam driving system having a first cam for vertically moving the die relative to the lower punch;

a second cam driving system having a second cam for vertically moving the upper punch;

a third cam driving system having a third cam for moving the feeder forward or backward relative to the cavity;

a contact member indirectly connected to the die and configured to move vertically with the die;

a stopper located above or below the contact member and configured to move relative to the contact member to come into contact with the contact member and move away from the contact member, the stopper being arranged to regulate relative vertical movement of the die with respect to the lower punch by being in contact with the contact member;

a fourth cam driving system having a fourth cam for vertically moving the stopper so that the stopper comes into contact with and moves away from the contact member; and drive synchronizing means for rotating the first cam, the second cam, the third cam, and the fourth cam in synchronism.

2. The molding apparatus according to claim 1, further comprising means for adjusting a height position of the contact member or the stopper.

3. The molding apparatus according to claim 2, wherein the drive synchronizing means has a main shaft connected to the first cam, the second cam, the third cam, and the fourth cam, and a drive motor for rotating the main shaft.

4. The molding apparatus according to claim 3, wherein the first cam driving system is configured to sequentially raise, stop, lower, and stop the die relative to the lower punch, in a first angular range, wherein the fourth cam driving system is configured to sequentially lower, stop, and raise the stopper, in the first angular range, wherein the stopper is located above the contact member, wherein the first cam driving system raises and stops the die relative to the lower punch by movement of the first cam, wherein the fourth cam driving system lowers, stops, and raises the die relative to the lower punch by movement of the fourth cam while the first cam driving system stops the die, and wherein the first cam driving system stops the die relative to the lower punch by the movement of the first cam while the fourth cam driving system raises the die.

5. The molding apparatus according to claim 1, wherein the drive synchronizing means has a main shaft connected to the first cam, the second cam, the third cam, and the fourth cam, and a drive motor for rotating the main shaft.

6. The molding apparatus according to claim 5, wherein the first cam driving system is configured to sequentially raise, stop, lower, and stop the die relative to the lower punch, in a first angular range, wherein the fourth cam driving system is configured to sequentially lower, stop, and raise the stopper, in the first angular range, wherein the stopper is located above the contact member, wherein the first cam driving system raises and stops the die relative to the lower punch by movement of the first cam, wherein the fourth cam driving system lowers, stops, and raises the die relative to the lower punch by movement of the fourth cam while the first cam driving system stops the die, and wherein the first cam driving system stops the die relative to the lower punch by the movement of the first cam while the fourth cam driving system raises the die.

7. The molding apparatus according to claim 1, wherein the first cam driving system is configured to sequentially raise, stop, lower, and stop the die relative to the lower punch, in a first angular range, wherein the fourth cam driving system is configured to sequentially lower, stop, and raise the stopper, in the first angular range, wherein the stopper is located above the contact member, wherein the first cam driving system raises and stops the die relative to the lower punch by movement of the first cam, wherein the fourth cam driving system lowers, stops, and raises the die relative to the lower punch in accordance with movement of the fourth cam while the first cam driving system stops the die, and wherein the first cam driving system stops the die relative to the lower punch by the movement of the first cam while the fourth cam driving system raises the die.

8. The molding apparatus according to claim 2, wherein the first cam driving system is configured to sequentially raise, stop, lower, and stop the die relative to the lower punch, in a first angular range, wherein the fourth cam driving system is configured to sequentially lower, stop, and raise the stopper, in the first angular range, wherein the stopper is located above the contact member, wherein first cam driving system raises and stops the die relative to the lower punch by movement of the first cam, wherein the fourth cam driving system lowers, stops, and raises the die relative to the lower punch by movement of the fourth cam while the first cam driving system stops the die, and wherein the first cam driving system stops the die relative to the lower punch by the movement of the first cam while the fourth cam driving system raises the die.

9. A molding apparatus for compacting a powder into a predetermined shape, comprising:

a die having a cavity into which the powder is filled;

a lower punch arranged to be inserted into the cavity from a lower side of the die;

an upper punch arranged to be inserted into the cavity from an upper side of the die to compact the powder filled in the cavity, in cooperation with the lower punch;

a feeder for feeding the powder into the cavity;

a first cam driving system having a first cam for vertically moving the die relative to the lower punch;

a second cam driving system having a second cam for vertically moving the upper punch;

a third cam driving system having a third cam for laterally moving the feeder;

a contact member indirectly connected to the die and configured to move vertically with the die;

a stopper located above or below the contact member and configured to move relative to the contact member to come into contact with the contact member and move away from the contact member, the stopper being arranged to regulate relative vertical movement of the die with respect to the lower punch by being in contact with the contact member;

a fourth cam driving system having a fourth cam for vertically moving the stopper so that the stopper comes into contact with and moves away from the contact member; and drive synchronizing means for rotating the first cam, the second cam, the third cam, and the fourth cam in synchronism.

* * * * *